United States Patent [19]

Poldervaart

[11] Patent Number: 4,534,740

[45] Date of Patent: Aug. 13, 1985

[54] SYSTEM FOR MAINTAINING A BUOYANT BODY IN POSITION IN RELATION TO ANOTHER BODY

[75] Inventor: Leendert Poldervaart, La Turbie, France

[73] Assignee: Single Buoy Moorings, Inc., Marly, Switzerland

[21] Appl. No.: 502,733

[22] Filed: Jun. 9, 1983

[30] Foreign Application Priority Data

Jun. 9, 1982 [NL] Netherlands ..... 8202334

[51] Int. Cl.[3] ..... B63B 21/52

[52] U.S. Cl. ..... 441/3; 441/4; 114/230

[58] Field of Search ..... 441/3, 4, 5; 114/125, 114/230, 374

[56] References Cited

U.S. PATENT DOCUMENTS

| | | | |
|---|---|---|---|
| 1,913,830 | 6/1933 | Campbell | 114/374 |
| 2,895,300 | 7/1959 | Hayward | 114/125 |
| 3,259,927 | 7/1966 | Devis | 441/3 |
| 3,354,479 | 11/1967 | Koppenol et al. | 441/5 |
| 3,380,091 | 4/1968 | Sawrin | 441/4 |
| 3,695,209 | 10/1972 | Giese | 114/230 |
| 3,726,247 | 4/1973 | Dalzell | 114/230 |
| 3,783,816 | 1/1974 | de Chassy et al. | 441/3 |
| 3,908,212 | 9/1975 | van Heijst | 441/5 |
| 4,088,089 | 5/1978 | Flory | 114/230 |
| 4,182,389 | 1/1980 | Guillaume et al. | 441/4 |

FOREIGN PATENT DOCUMENTS

| | | | |
|---|---|---|---|
| 2420475 | 10/1979 | France | 114/230 |
| 7614397 | 12/1976 | Netherlands | 441/4 |
| 7802200 | 2/1978 | Netherlands | 441/4 |
| 1093860 | 12/1967 | United Kingdom | 114/230 |
| 2019800 | 2/1983 | United Kingdom . | |

*Primary Examiner*—Trygve M. Blix
*Assistant Examiner*—Edwin L. Swinehart
*Attorney, Agent, or Firm*—Young & Thompson

[57] ABSTRACT

A system for maintaining a vessel (4) in a predetermined position with respect to another body (1, 20, 63, 74) such as a buoy (1), the system comprising a stiff arm (11, 12, 18, 22, 33, 43, 44, 50) connected to the buoy (1) or the like anchored body (1, 20, 63, 74) with one end and cooperating at the other end or ends with structure (7, 28, 38, 39) such as cables (7) which are suspended from the vessel (4) and carry a weight (8, 9, 10, 30, 31, 36, 37, 78), this structure (7, 28, 38, 39) being connected to the stiff arm (11, 12, 18, 22, 33, 43, 44, 50) or being guided (15, 27, 40, 41) through the arm (11, 12, 18, 22, 33) which arm (11, 12, 18, 22, 33) extends at or above water level.

4 Claims, 15 Drawing Figures fig-1
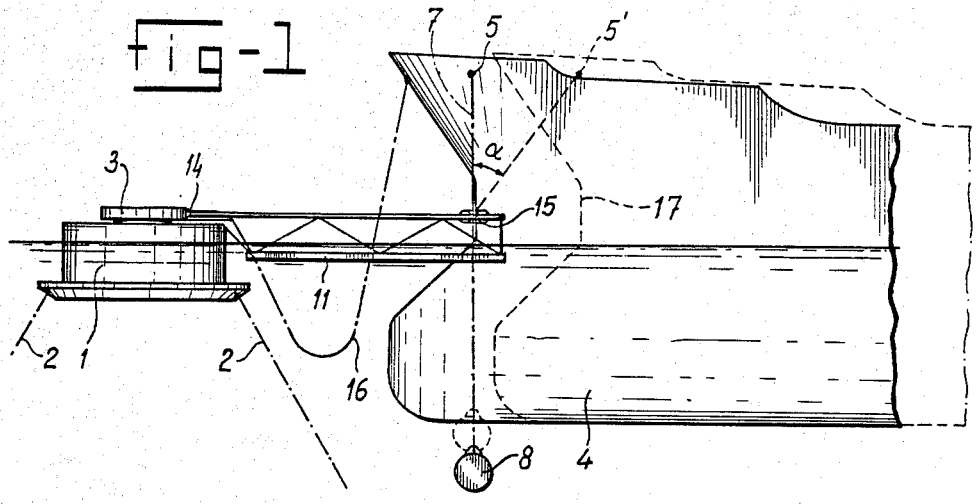
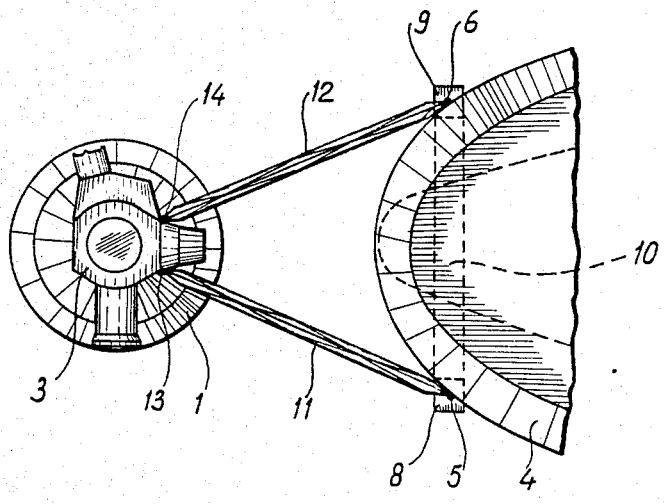
fig-2

SYSTEM FOR MAINTAINING A BUOYANT BODY IN POSITION IN RELATION TO ANOTHER BODY

The invention relates to a system for maintaining a buoyant body, such as a vessel, in a position in relation to another body with means to keep it in place, such as a buoy having anchor chains, a tower having a movable joint with a bottom anchor or a rigid tower, which position determining system between the two bodies comprises a stiff arm attached to one body, such as the buoy or the like and having its other end cooperating with connecting means which extend downwardly from the other body, such as the vessel and below water level are attached to a weight, the point of cooperation between said connecting means and the stiff arm being situated between the suspension point of the connecting means and the weight.

Such a system is known for instance from the published U.K. Patent Application No. 2,019,800, especially FIG. 5 thereof.

The object of this known system is to keep both bodies at a mutual distance by attaching a stiff arm pivotably to the one body, and connecting the other end of said arm pivotably to a rod, which extends upwardly and is pivotably connected to the other body, such as the vessel, a weight being suspended from the point where arm and rod are interconnected.

If for one reason or another the distance between both bodies increases or decreases, then said weight will be lifted whereby the vertical position of the rod will move into an angular position in relation to the vertical direction. Dependent on the magnitude of said angle a horizontal reset component is generated where the rod is attached to said other body, which reset component tries to restore the original distance between both bodies. In general one can think hereby of the connection between a ship, such as a tanker, and a mooring device, such as a buoy or tower, wherein furthermore hoses for transporting fluids such as oil extend between the ship and said mooring device.

To avoid collision between the ship and the weight the stiff arm it is necessary to locate said weight at a great depth. In view of this requirement, the arm and rod have their point of interconnection far below water level as a result of which only after a significant angular displacement will a reset component be generated which is able to move the ship back against the influence of the forces disturbing the ship's positioning and notwithstanding the great mass of the ship. It is not possible to increase the mass of said weight unrestrictedly because then the system as a whole becomes unmanageable, the rod and the cable or cables carrying the weight will be overloaded and it will be very difficult if not impossible to realize the connection with a ship.

Moreover the hoses beween the two bodies cannot be supported by the arm and if this were done they would not be accessible.

An object of the invention is to provide a very simple system making it possible to create the desired reset component faster wihout using an excessively heavy weight, end to provide a system which operates substantially free from waves.

Said object according to the invention is reached in that the stiff arm or arms extend at or above water level between the anchored body, such as the buoy and the connecting means.

By means of this measure one attains that the weight can be installed still without changes at the desired great depth, whereas the point where the connecting means cooperate with the arm is positioned at a much higher level, so that although the desired depth for the weight is maintained, the effective length for creating the reset component is short. A small dislocation of the ship creates already a large angle between the connecting means and the vertical direction causing therefore a large reset force derived from said weight.

One obtains so to speak in a very simple way a stiff spring action instead of the known soft spring. Moreover the arm now can support hoses and they are accessible. Also the arm can be made shorter. Furthermore one obtains the possibility to make said spring adjustable by chosing the location where the arm cooperates with the connecting means. The invention is not only of interest for mooring a ship to a buoy or tower, but also for mooring a ship to a quay, an artificial island, which is erected at a fixed place or a floating island, which by means of anchor chains or by means of automatic position determing means cooperating with propulsion means is maintained in position.

Preferably the connecting means are formed by a cable or cables extending between the supporting point or points on the body and the weight or weights.

Under the influence of disturbing forces caused by waves, currents and wind the ship carries out not only movements directed away from the buoy and towards said buoy, the so-called drifting movements, but tries also to carry out rotational movements around the vertical axis and around the point of connection with the buoy, that means around a point near said buoy. Furthermore the ship may move parallel to its longitudinal axis and may furthermore carry out rolling movements around said longitudinal axis or around a transverse axis.

A further object of the invention is to provide a system for maintaining a vessel in position, by means of which system at least part of said movements is absorbed and by means of which rotational movements, especially shearing movements around a point near the bow can be counteracted by creating a reset force.

According to the invention said object is achieved in that the buoyant body from which said weight is suspended comprises two suspension points at a mutual distance, whereby the weight or weights suspended from said points each cooperate with the arms or arm. The weight or weights now act on two points having a mutual distance which points are in different ways displaced during the ship's movements so that the weight or weights will be lifted in different ways and their connecting rods or cables will make different angles with the vertical directions at the points where said rods or cables co-operate with the arm or arms. Preferably the suspension points are located at both sides of the longitudinal axis or bow of the body concerned. By situating the suspension points at both sides of the bow the rotational movements around the bow are counteracted because the weight which is lifted to the highest level creates a reset force. It is desirable, however, that both connecting means or cables maintain their mutual distance which can be promoted by a stiff transverse arm having flexible joints between the connecting means or between an arm and the weight, or by means of a stiff distance element between said weights. It is also possible to attain this object by using one single weight extending a transverse direction in relation to the longitudinal axis of the ship and suspended by two connecting means. Said stiff distance element results in an increased reset force, because the weights are not able to move away from or towards each other. Without said distance element the longitudinal displacements of the ship in the direction of the other body would result in a movement of the arms away from each other, however, without creating a sufficiently large angle between the connecting means and the vertical direction to create the desired reset force in the drifting direction. This problem is eliminated when the ship is moving towards the other body.

It is also possible to locate the suspension points along one side of the longitudinal axis or bow of the ship whereby two weight carrying connecting means cooperate with one single arm.

Instead of one or two suspension points also a number of suspension points can be used.

According to the invention the arm or arms may have a fixed point of attachment to said connecting means. In that case said arms move together ith said weight upwards or downwards and the connecting means could be rods.

Another possibility is to make the arm or arms buoyant upon the connecting means are guided through an opening in said arm or arms. Then they preferably are formed by cables. If in that case the ship is displaced then said cables beween the ship and the weight or weights will move through said guiding opening, which will maintain its position near the water surface. As a result of the reset force also a force will be created tending to press the floating arm downwards. Therefore one has to decide for each specific case separately how much buoyancy capacity is to be installed in each arm or arms and how the increase or decrease of the buoyancy at the location where the arms interact the water surface can be influenced by means of the shape of said arms.

Both arms connected tightly to the connecting means as well as arms having buoyancy are positioned above the water level and may carry conduits or hoses. These conduits aand hoses and the buoy are accessible from the ship.

It is known that under the influence of wave forces a ship connected to a mooring device can drift to a large extent. An object of the invention is to decrease said drift movements and said object according to the invention is achieved in that in addition to the connecting means between the one body and the weight or weights a connection is installed between both bodies, which last mentioned connection is kept under tension. The use of this further connection results in a bias tension in the connecting means, from which the weights are suspended because this further connection draws the ship closer to the buoy so that the connecting means carrying the weights are biased into a predeterminable inclined position in relation to the vertical direction. This additional connection can be embodied as one or more tension cables, however, it also can be embodied as a weight loaded chain or cable.

When the connection means for the weights are guided through an opening then it is according to the invention possible that the arm or arms be integrated to that part of the anchored buoyant body which is rotatable around a vertical axis in relation to the anchored part thereof. Said rotatable part of the buoy may for instance have the form of a U-shape and can have buoyancy as a whole. It is also possible to use two floats positioned at a mutual distance parallel to each other by thereto connected arms. Said arms can form together with said floats a stiff configuration in case guiding openings are used.

In case the arms are not integrated with the buoy then said arms, which have a tight or pivotable connection with the weight carrying connecting means must have a flexible joint with the buoy having at least a pivoting capacity around a horizontal axis.

In case arms are used having buoyancy of their own, then it is also possible to use such flexible joint with the buoy.

Using a flexible joint between the arms and the buoy, such that said arms can move away from each other, it is attained that the ship cannot touch said arms.

Flexible joints used in a mooring system are known themselves, for instance from the U.S. Pat. No. 3,380,091.

An arm, attached to a buoy, to which a ship can be moored such that the chip is connected to said buoy as well as to said arm by means of cables is also known, for instance from the British Patent 1,093,860. Both cases, however, relate to other mooring systems without any means to generate a reset force.

The means for biasing the weight carrying connection means can be coupled to the buoy at the location of the turntable. The result thereof is that the turntable will keep its correct orientation in relation to the ship.

The same object can be achieved by other connection means such as an additional strut from one arm to a point on the turntable other than the point where the arm concerned is attached to said turntable or by means of crossing tensioning means between said arms.

According to the invention it is furthermore possible that the weight carrying connection means extend from the weight to said other body.

The additional connection means are in that case formed by extensions of the cables which can if desired be weight loaded. One attains thereby that shearing of the turntable is counteracted, swaying of the weights is prevented and the safety is increased in case a joint between an arm and the buoy or such breaks.

According to the invention it is preferred that the distance element and/or the weights, which may be integrated together, comprise ballast spaces which can be emptied, so that the whole configuration can have buoyancy simplifying the connection with a ship.

It is conceivable to suspend the weights pivotably from the ends of the arms by means of rods whereby between said ends of the arms and the ship also rods are attached of which the ends are pivotably connected.

It is also conceivable to attach the weight rigidly, with one or more rigid connecting means whereby the end of the arm or arms is pivotably connected to said rigid connecting means.

The invention will now be explained in more detail with reference to the drawings.

FIG. 1 illustrates schematically a side-view of an embodiment of the system according to the invention.

FIG. 2 is a top plan view of FIG. 1.

FIG. 11 illustrates in a side-view the principle of biasing tension in an embodiment of the invention of which

Figure 3:
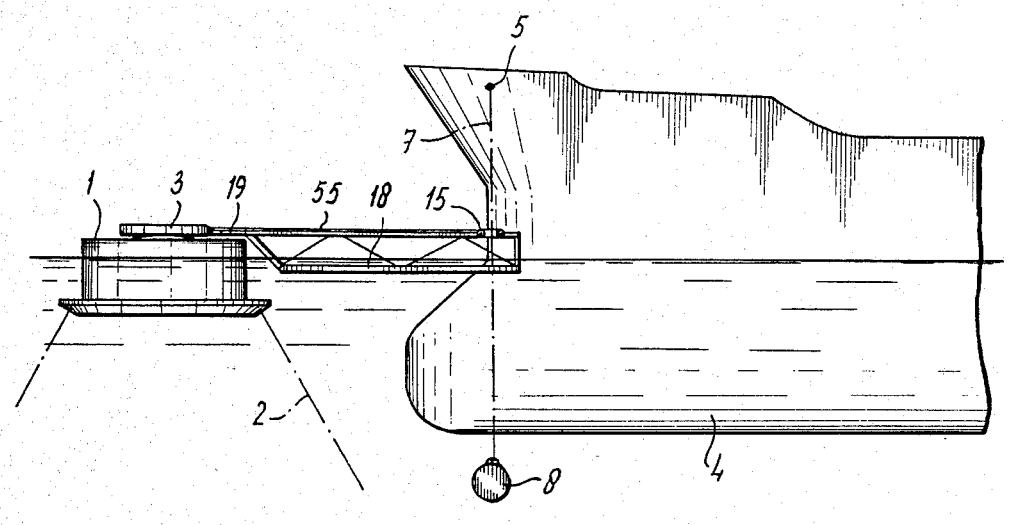
FIG. 3 illustrates a variant of FIG. 1.

The FIGS. 1 and 2 illustrate buoy 1 which is anchored by means of anchor cables 2. A turntable 3 is installed on said buoy.

A tanker 4 is moored to said buoy, from which tanker the weights 8 and 9 are suspended by means of cables or chains 7 attached at 5 and 6, respectively, to said tanker, which weights can be coupled by means of a distance element 10.

Two arms 11 and 12 are attached to the turntable preferably using a flexible joint for the connection with said turntable at 13 and 14, respectively, which flexible joint may be a horizontal pivot shaft or a universal joint. The connection can also comprise a flexible strip.

The arms 11 and 12 must have the possibility to move independently of each other. Both arms have their own buoyancy capacity, which is for instance realized by constructing them in the form of a lacing of hollow tubes.

Each arm 11 or 12 has a guiding opening 15, which can be constructed in any suitable way and may comprise for instance guiding rollers. The cable 7 runs through said guiding opening.

Between the bow of the ship 4 and the turntable 3 a further chain 16 is provided to keep the turntable oriented in relation to the ship and tending to draw the ship towards the buoy because of its own weight.

If the ship is displaced in relation to the buoy 3 in an undesirable way, as is indicated by broken line 17, the suspension point of the cable or cables 7 will move from 5 to 5'. The force in the connection means 7 as result of the weight 8 will then be dependent on the angle $\alpha$ to create a reset component tending to move the ship back to the original location. If the ship is moving according to a straight line away from the buoy, then both weights 8 and 9 are lifted to the same degree and the created reset forces will be equal.

However, if the ship is yawing around the bow then two differently directed reset forces will be generated counteracting said rotaional movement.

Figure 4:
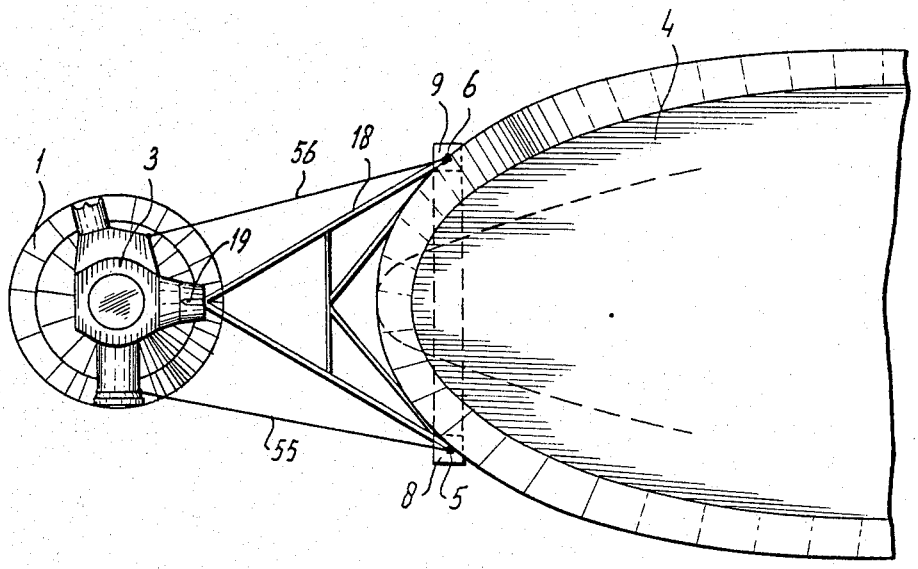
FIG. 4 shows a top view of FIG. 3.

In the embodiments of FIGS. 3 and 4 the buoy 1 and the turntable 3 are as in the embodiment illustrated in FIGS. 1 and 2. The same applies to the tanker 4, the weights 8 and 9 and the connection means 7 through which the weights are suspended from the ship at 5 and 6.

In this case the arm is embodied as an A-shaped frame 18 having a flexible connection at 19 to the turntable or having a connection with horizontal longitudinal and transverse pivot shafts, the legs of which frame extend on both sides of the bow and each leg has a guiding opening 15.

This A-shaped frame 18 can be embodied such that the connection means 7 to the weights 8 and 9 are maintained at a mutual distance, in which case the distance element 10 can if desired be eliminated.

Figure 5:
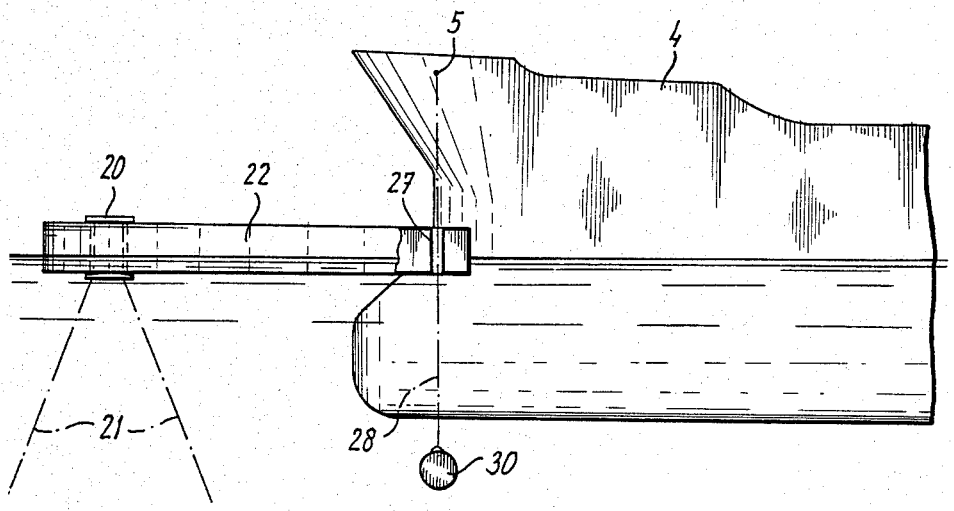
FIG. 5 is a side-view of another variant.
Figure 6:
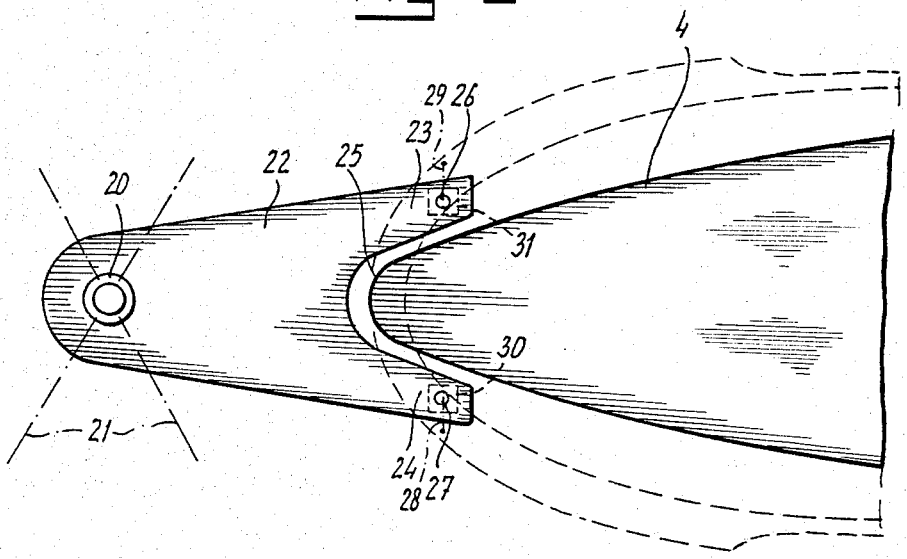
FIG. 6 is a top view thereof.

The embodiment illustrated in FIGS. 5 and 6 is distinguished from the preceding embodiments in that the buoy comprises a central core 20 to which the anchor chains 21 are connected. Around said core 20 a buoy body 22 having its own buoyancy is rotatable, which body is a U- or V-shaped body (with reference to FIG. 6) of which the legs 23, 24 are positioned on both sides of the bow 25, which legs have guiding openings 26, 27 through which the connection means 28, 29 carrying the weights 30 and 31 are guided.

Figure 7:
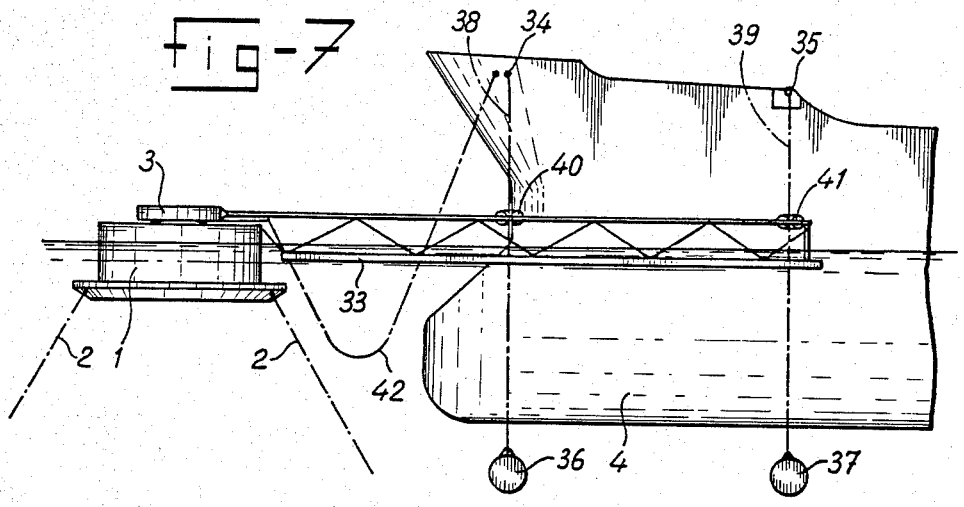
FIG. 7 is a side view of a further variant and FIG. 8 is a top view thereof.
Figure 8:
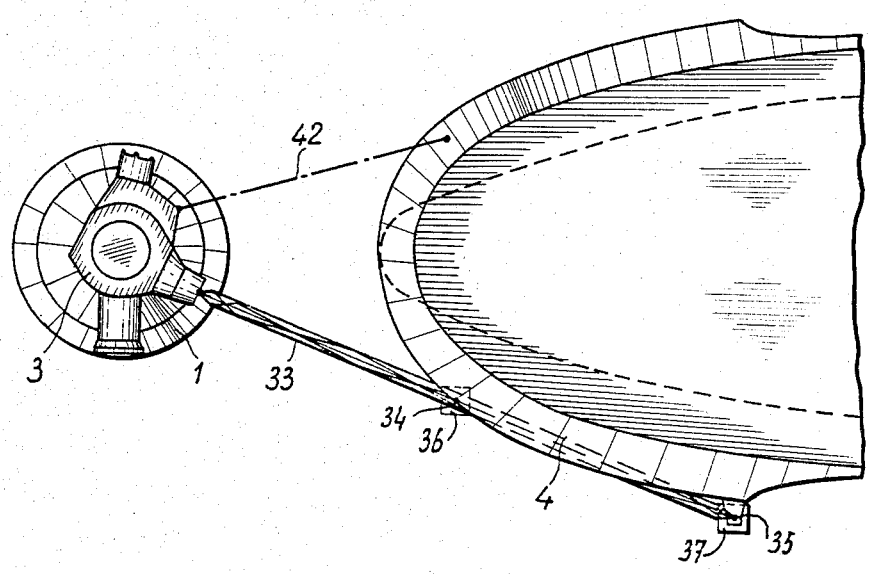

In the embodiment illustrated in the FIGS. 7 and 8 the same buoy is used as in FIGS. 1 to 4. However, the turntable 3 is connected to only one arm 33, which arm has its own buoyancy. The suspension points 34 and 35 for the weights 36, 37 are located on one side of the bow of the ship 4 at a mutual distance, and the connection means 38, 39 extends through the guiding openings 40 and 41 of the arm 33.

A chain 42 extends between the ship and the turntable 3 by means of which the connection means 38 and 39 can be pretensioned and the turntable can be maintained oriented.

Figure 9:
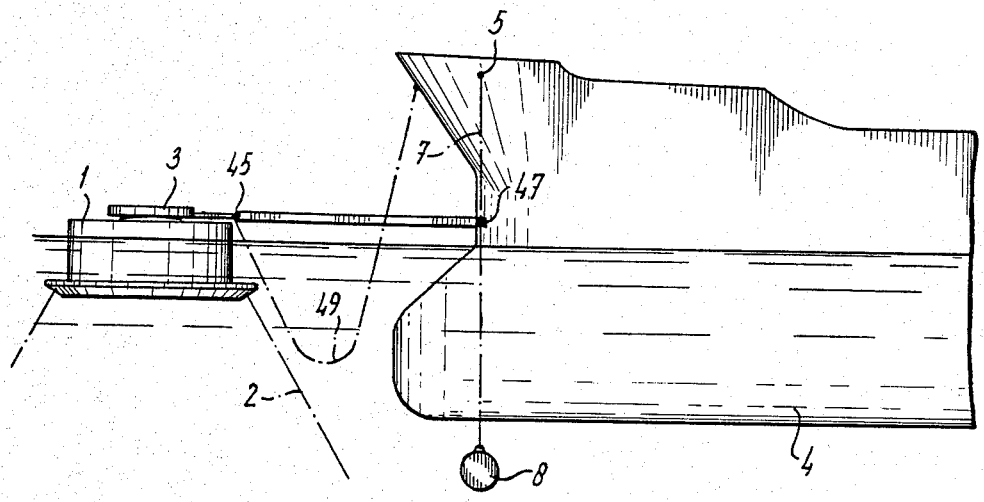
FIG. 9 is still a further variant and FIG. 10 is a top view thereof.
Figure 10:
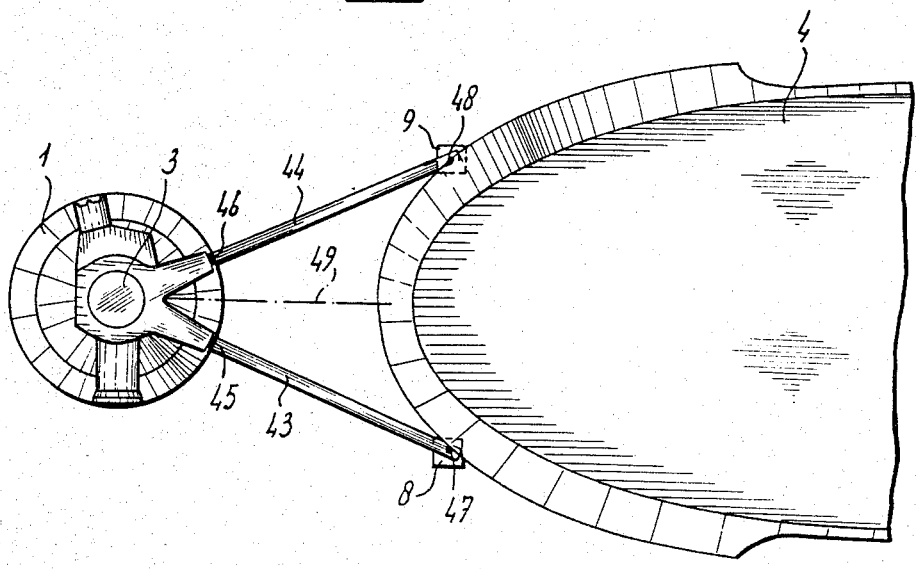

In the embodiment according to FIGS. 9 and 10 again the same buoy 1 and turntable 2 are used as in FIGS. 1 to 4 and 7 and 8, and furthermore a similar ship 4, from which the weights 8 and 9 are suspended by means of cables 7. In this embodiment two stiff arms 43 and 44 are used, which at the points 45, 46 can have a flexible joint or a joint with a horizontal pivot shaft with the turntable 3, whereaas they are securely connected to the cables 7 at 47 and 48, respectively.

Figure 11:
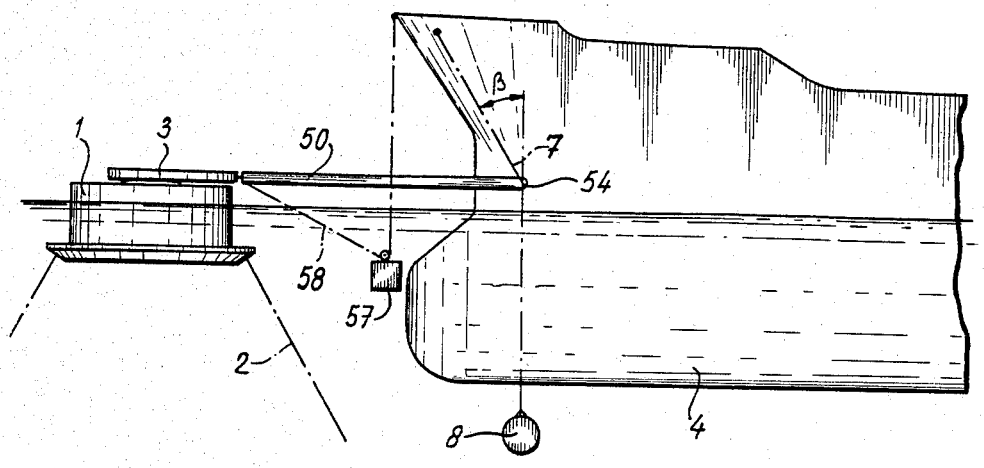
Figure 12:
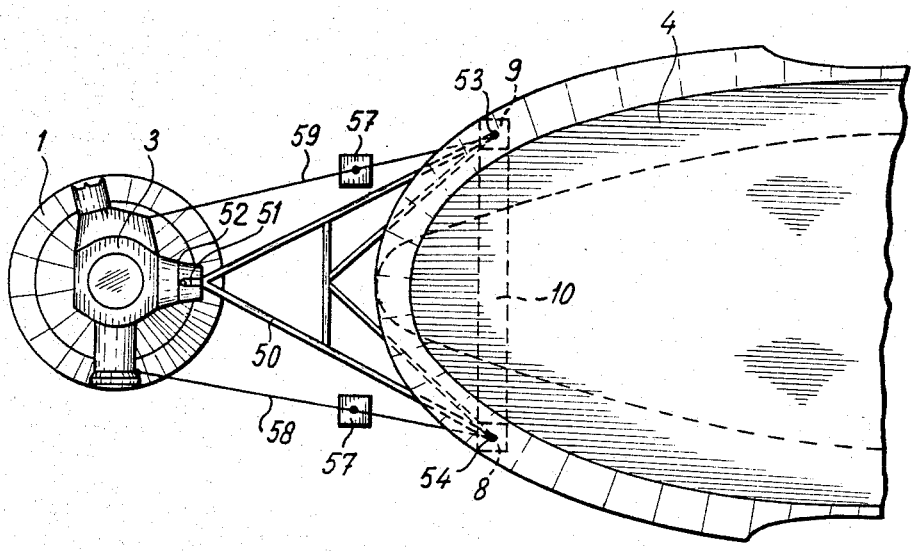
FIG. 12 shows a top view.

Also in this embodiment one can use a chain 49 between the front bow of the ship 4 and the turntable 3, which chain under the influence of its own weight or under the influence of an attached weight will draw the ship 4 in the direction of the bow 1 thereby pretensioning the whole configuration. What exactly is meant by this "pretension" is indicated in FIG. 11. FIGS. 11 and 12 illustrate an embodiment different from FIGS. 9 and 10 because the arm is formed as an A-shaped frame 50, comparable with the frame illustrated in FIG. 4, which frame 50 can have at 51 a pivotable joint with the turntable having an axis which is radial in relation to the axis of rotation of the table and which can have at 52 a joint around a horizontal axis transverse thereto. Instead of the pivot joints 51 and 52 also a flexible joint is conceivable. The ends of the legs of the frame 50 are securely connected at 53 and 54 to chains or cables 7 carrying the weights 8 and 9 respectively which can be mutually coupled to a distance element 10.

Whereas in the embodiment according to FIGS. 3 and 4 horizontal elastic tensioning cables 55, 56 can be used, an embodiment which is also conceivable for FIGS. 11 and 12, in these last-mentioned Figures a connection is illustrated by means of cables 58 and 59, carrying a weight 57. Said weights 57 draw the ship into the direction of the buoy 1, so that the cable 7 above the point of attachment 54, 53 is inclined in a forward direction making an angle $\beta$ with the vertical direction . The reset spring, formed by the cable 7 and the weights 8 and 9, which is in a similar way pretensioned, will further decrease the maximum drift movements of the ship 4.

Figure 13:
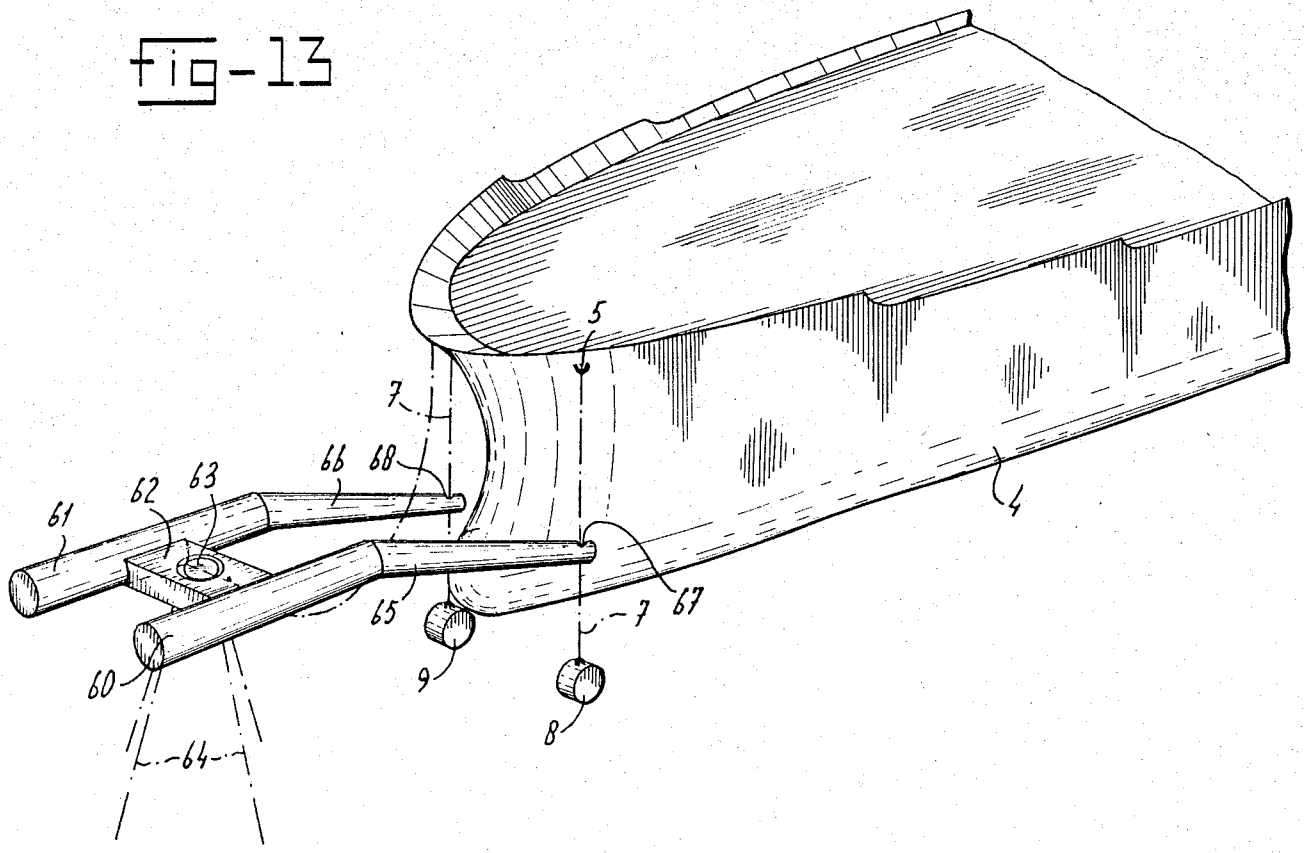
FIG. 13 is a perspective view of another embodiment.

FIG. 13 shows an embodiment in which the buoy comprises two floats 60 and 61, connected to each other by means of a transverse girder 62, in which transverse girder a crown 63 is borne for rotation around a vertical axis, to which crown the anchor chains 64 are attached. The floats have each a connecting arm 65 or 66 secured thereto, of which the end at 67 or 68 respectively provides a guiding opening for the cables or chains carrying the weights 8 or 9 respectively, which chains, however, also can be securely attached at those points. In this last-mentioned case, the connection between the arms 65 and 66 and the floats 60, 61 could be flexible, but it is aalso conceivable to maintain a tight connection. Displacement of the ship from the desired position results then in an upwards or downwards movement of the floats 60 and 61, which might be advantageous under certain circumstances. The tightly connected arms 65 and 66 and the arms which are by means of a horizonal pivot shaft connected to said floats, are sufiiciently maintained in two parallel vertical planes to function as a distance element between the weights 8 and 9.

Figure 14:
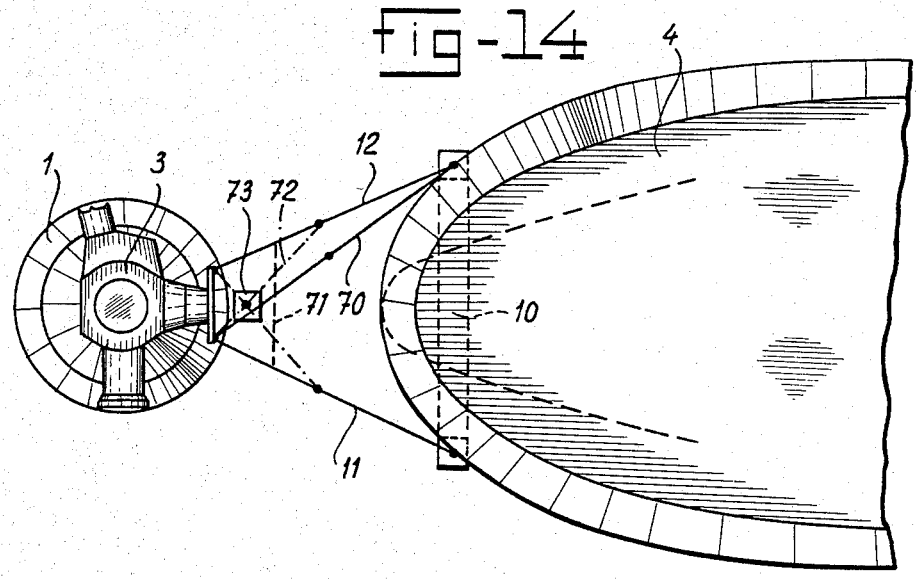
FIG. 14 illustrates in top view possibilities to prevent shearing of the turntable.

FIG. 14 illustrates a buoy 1 with a turntable 3 and a ship 4. The weights 8, 9 and the distance element 10 are again suspended from the ship and arms 11 and 12 extend from the turntable to the connection means. To prevent shearing of the turntable 3, which is possible because of the flexible joints of the arms 11 and 12 with the turntable, one can use a further strut 70. Another possibility is the use of additional tensioning cables 71 and 72, crossing each other and loaded if desired by means of a weight 73 at the cross point.

Figure 15:
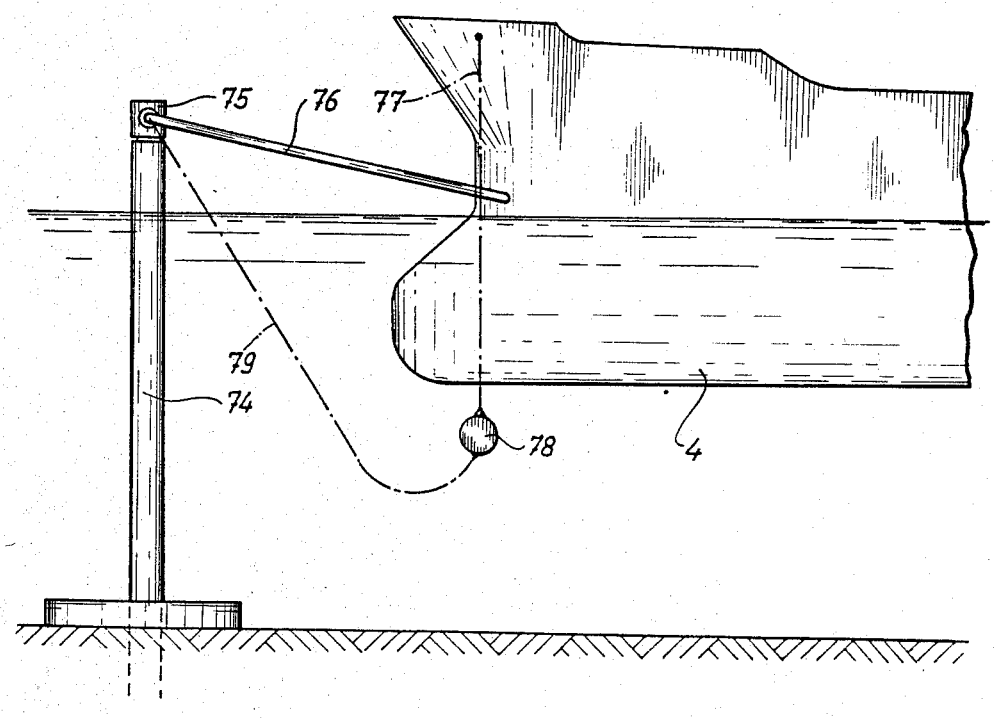
FIG. 15 illustrates another possibility in side-view.

FIG. 15 illustrates a ship 4 which is moored to a tower 74 standing on the sea-bottom or existing as a column with its own buoyancy connected swayably to a bottom anchor. The tower 74 carries at its upper end a rotatable part 75 with thereto connected arms 76 cooperating with connection means 77 carrying the weight(s) 78.

The connection means are now extended by means of a part 79 extending from the weights 78 upwards again to the turntable 75. Said extension 79, which can be embodied as an a weight loaded chain if desired, prevents sheering of the turntable and swaying of the weights 78. If the connection between an arm 76 and the turntable were to break, then in any case the ship would be connected by means of the chains 77, 79 and the weight 78.

I claim:

1. In a mooring system for maintaining a vessel on the surface of a body of water in a position in relation to a body which is secured to the bottom of the body of water, which mooring system comprises a rigid arm attached at one end of the arm to said body for horizontal swinging movement relative to said body about a vertical axis, said arm having its other end cooperating with connecting means which are suspended from the vessel and are attached to a weight, the point of cooperation between said connecting means and the rigid arm being situated between the suspension point of the connecting means and the weight; the improvement in which said connecting means comprise at least one flexible cable directly connected to the vessel at its upper end, said rigid arm and said point of cooperation being disposed at least as high as said surface of said body of water and said weight being disposed below said surface of said body of water, said arm and said vessel being movable horizontally relative to each other, the weight urging said vessel to move horizontally toward a position in which the connecting means above the arm is vertical.

2. System according to claim 1, in which said at least one cable is fixedly secured to said rigid arm.

3. System according to claim 1, in which said arm is buoyant and said at least one cable is guided through at least one opening in said arm for vertical movement of said arm and said at least one cable relative to each other.

4. Mooring system as claimed in claim 1, in which said other body is a buoy anchored to the bottom of the body of water by means of chains and floating on the surface of the water.

* * * * *